US005601336A

United States Patent [19]

Troyas-Bermejo

[11] Patent Number: 5,601,336

[45] Date of Patent: Feb. 11, 1997

[54] AUTO BALANCING ERGONOMIC ARMCHAIR

[75] Inventor: Victor Troyas-Bermejo, Navarra, Spain

[73] Assignee: Manufacturas Metalicas Jevit, S.A., Navarra, Spain

[21] Appl. No.: 427,115

[22] Filed: Apr. 21, 1995

[30] Foreign Application Priority Data

Apr. 21, 1994 [ES] Spain ..... 9400840
Apr. 21, 1994 [ES] Spain ..... 9400841

[51] Int. Cl.[6] ..... A47C 3/00

[52] U.S. Cl. ..... 297/300.4; 297/316; 297/321; 297/300.2

[58] Field of Search ..... 297/300.4, 296, 297/297, 300.2, 300.6, 300.8, 301.1, 301.5, 307, 316, 321

[56] References Cited

U.S. PATENT DOCUMENTS 4,270,797 6/1981 Brauning ..... 297/300.6 X
4,685,733 8/1987 Machate et al. ..... 297/300.4 X
4,743,065 5/1988 Meiller et al. ..... 297/300.8 X
4,966,411 10/1990 Katagiri et al. ..... 297/321 X

*Primary Examiner*—Laurie K. Cranmer
*Attorney, Agent, or Firm*—Leydig, Voit & Mayer, Ltd.

[57] ABSTRACT

An ergonomic self-balancing armchair having a seating element, a holding support and a mechanism for regulating the angular position of the seating element. The regulating mechanism has an articulated triangle structure, in which the angular ends define free turning spindles. One side of said triangle defines a fixed length and fixed position, and a second side defines fixed length and tilting position, and a third side defines variable length and tilting position. The seating element is supported and fixed upon the second and third sides, whereas through the first side is assembled the supporting mechanism. The spindle is made up of the torsion bar that is mounted so that it turns freely upon side and has fitted at one end side and the opposite end a regulating control lever.

15 Claims, 11 Drawing Sheets

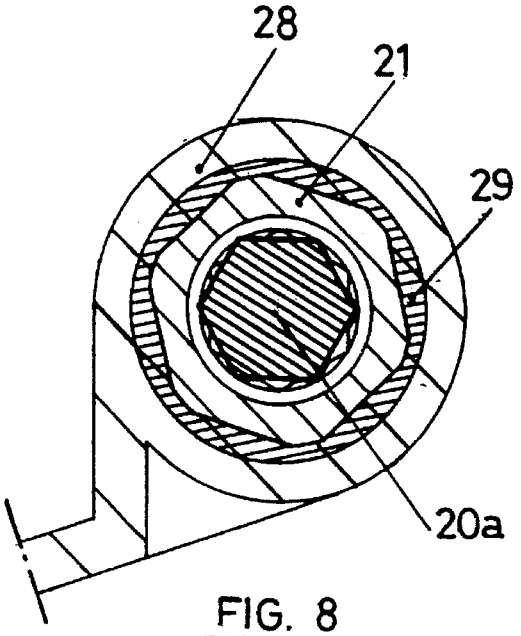
FIG. 8
FIG. 9
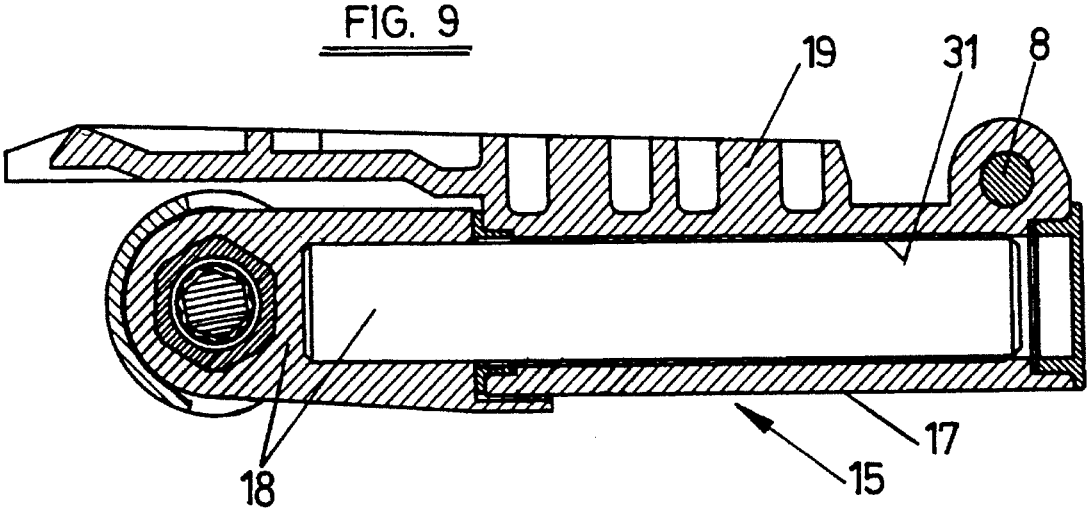

AUTO BALANCING ERGONOMIC ARMCHAIR

FIELD OF THE INVENTION

This invention refers to an auto balancing ergonomic armchair, with adjustable angular position designed so that it maintains stable equilibrium at any selected angular position.

BACKGROUND OF THE INVENTION

The term "ergonomic armchair" generally refers to those pieces of seating furniture offering outstanding anatomical support and further allowing easy anatomical modification and repositioning, in accordance with the movements and wishes of the user.

More specifically, the armchair of this invention is of the type comprising a seating device, a supporting structure upon which the seating device is fitted, and a mechanism for joining the seating device and the seating structure and allowing regulation of the angular position of the seating device relative to the supporting element. The seating device may comprise a front cushioned element and a rear frame which is anchored to the regulating mechanism through the seating area and which is molded so that it has flexible cross-sectional fibs.

The position and anatomical modifications of the seating and seat back surfaces are generally achieved by combining the partial deformation capacity of the body defining the armchair seat and seat back areas with the action of a regulating mechanism that links the seating area to the lower supporting element.

European Patent No. 309,368 describes an armchair in which the frame of the seating device is made of only one piece and has cross-sectional deformation capacity. The mechanism that regulates the angular position of the seating device has a turning plate fitted upon a cross-sectional axis of the seating area and a spring disposed between a fixed point of the rigid support and the turning plate, so that whenever the seat tilts backwards, the plate turns and compresses the spring.

A proper seating device stability is not achieved for the seating device, in the various adjustable angular positions, unless the degree of compression of the spring is properly set beforehand as a function of the weight of the user. The seating device frame also requires a special arrangement to allow the upper portion of the seat back to bend backwards. The bending area of the upper seat back frame includes a structure built with flexible cross-sectional ribs that act as intermediate hinges. The seating frame has a structure formed on the basis of tubular profiles that run, upon the seating area, under that same area and within the seat back area.

The structure of such a seat back upper bending area increases fabrication costs considerably and does not allow a seat back high enough to support the shoulders, so that it does not offer maximum support, particularly for full back support. The structure does not permit transfer upon the seat certain torsion movements and furthermore does not support high seat back cross-sectional torsion movements. With respect to the seating area, the frame works under traction and flexion, thus reducing its working life.

European patents Nos. 309,368 and 309,369 describe a chair or armchair that includes a seating device made up by a back shell or frame and a front cushioned element. The back shell or frame, made of a plastic material piece, has a substantially rigid structure, except at an intermediate area of the seat back, which is flexible and deformable only in its longitudinal direction. This flexibility is achieved through a structure, in the intermediate seat back area, having parallel rigid cross-sectional blocks, consecutively connected by intermediate membranes with a greater flexibility. The capacity of deformation of the structure depends on the number of blocks and membranes, as well as of the width and nature of the membranes. The shell or frame includes a metal structure that extends below the back portion of the seating element, crosses the shell and extends above the flexible intermediate surface of the seat back.

This solution presents the problem that seat back deformation may extend beyond the limits desired if a relatively high force is applied against it.

The structure of the shell or frame also makes it considerably more expensive to manufacture and requires the use of materials capable of withstanding high deformation cycles, as it may otherwise result in the early breakage of some of the membranes forming part of the structure.

The only function of the metal structure of the frame is to lend it rigidity and, since it is disposed through the frame, it requires a complex assembly process.

OBJECTS AND SUMMARY OF THE INVENTION

The object of this invention is to provide an armchair that overcomes the previously mentioned inconveniences and that achieves a perfect synchronism between the movements of the various areas of the seating device, when varying its angular position, as well as a stable balance of any angular position selected of the seating device.

It is also an object of the invention to provide an armchair having a correct body support surface offering a maximum level of comfort and safety.

A further object of the invention is to provide an armchair that allows regulation of the angular position of the seating element through smooth and easily controllable movements.

These and other advantages are achieved through the combination of a new design and structure of a seating element and a new angular position regulating mechanism for the seating element.

In accordance with this invention, the mechanism for regulating the angular position of the seating element joins the seating element to the holding support. The regulating mechanism in its vertical section, defines an articulated triangular structure having angular points and three sides. The angular points have a matching number of turning horizontal and parallel spindles and the sides include a fixed length and fixed position (first) side, a fixed length and tilting position (second) side and a variable length and tilting position (third) side. The second and third sides have means to support and fix the seating element, whereas the mechanism is attached to the rigid support through the first side.

In the regulating mechanism, the articulation axis between the first and third sides has a torsion bar fitted so that it turns freely about the fixed length and fixed position side. One end of this torsion bar joins the variable length and tilting position side without any relative turn possibility. The opposite end of the torsion bar joins, also without any possibility of relative rotation, an adjustable position lever. The free end of the lever is supported on an actuating control set at the fixed length and fixed position side.

The variable length and tilting position side that forms part of the regulation mechanism comprises two parallel telescopic pins, each pin having two telescopically plugged sections. One of these sections joins the two pins of the upper rigid plate, whereas the other section joins both pins at their free end with the torsion bar. The seating area of the seating element is supported and fixed to the rigid plate before the articulation edge between the variable length and tilting position side and the fixed length and tilting position side.

The fore mentioned pins join the torsion bar through the tubular profiles of the bar. One of the pins is fixed to the corresponding tubular profile to prevent rotational movement, whereas the other pin is rotatably attached to the remaining tubular profile. The second pin includes an adjustable tension spring that acts against pin lengthening and which increases the response or recovery capacity of the seating element from its most backward or tilted position. On another side, the two pins have a contact bushing between their plugged sections that achieves a high level of compression between the pin sections and ensures a constant degree of friction without any adherence that may cause undesirable gripping or blocking between both sides that would result in discontinuities in the relative movement of its components.

The fore mentioned adjustable position lever is attached to the torsion bar through the same tubular profile which carries the pins rotatably attached to the variable length and position side.

The fixed length and adjustable position side, which forms part of the regulation mechanism, extends from the angular point of the variable length and position articulation, at a portion joining the rear section of the seating area of the seating element.

In accordance with another aspect of the invention, the body frame is subdivided into three structurally continuous areas, namely a lower seating area, an upper seat back area and an intermediate transition area.

A structure disposed in the internal surface of the frame regulates the cross-sectional bending capacity of the seat back area, while at the same time providing structural rigidity to the transition area. This arrangement also reinforces the bending motion of the seat back area so that it may withstand the forces exerted on the chair during use, without risk of breakage or bending up to an undesirable level. Furthermore, the seat back may adopt any inclination angle, sufficient to offer full back and shoulder support at the same time that it allows a certain degree of torsion so that a maximum level of safety and comfort is achieved.

The cushioned section of the seating element includes a lens shaped cross-section body that matches the transition area of the frame and offers efficient support to the pelvis area of the user.

Two bending areas are achieved in the frame by using the fore mentioned arrangement of the frame of the seating element and its anchorage to the regulating mechanism. One of the bending areas is located between the seating area and the transition area, whereas the other is in the lumbar area of the seat back.

The relative movement between the transition and frame seating areas are synchronized through the fore mentioned arrangement of the regulating mechanism and the seating element, thus preventing an excessive elevation of the leading part of the seating area. All of the above is achieved through the combination of the tilting and sliding movement of the seating element. The combination of the tilting and sliding movement of the seating element also achieves a relative bending motion along the neutral axis of the frame, located between the transition and seating areas, thus avoiding the traction efforts that take place in the traditional chairs of the same type.

This synchronization is further maximized through the possibility of bending of the lumbar area of the armchair seating element, together with the possibility of a given torsion movement in the upper portion of the seat back.

The regulation mechanism included in the armchair object of this invention achieves a stable equilibrium in any selected angular position of the body element, and also enhances the recovery capacity of the chair from its pushed back position, thus ensuring a permanent contact with the body of the user, should the user suddenly lean forward.

The reinforcing frame coupled to its internal surface in the frame of the seating element provides safety measures against sudden and strong supporting motions that may produce excessive seat back bending.

As previously mentioned, the regulating mechanism incorporates two elastic control elements. One of the control elements is defined by the torsion bar which constitutes the proper device controlling the movement of the seating element, whereas the other one is defined by the spring of one of the pins which increases the response capacity from the backmost position of the seating element. The tension of these two elastic elements may be regulated using the relevant controls.

Another object of this invention is to provide a chair having a seating element frame or shell made up of only one part without discontinuities or sudden interruptions and having a controlled flexibility sufficient to obtain an elastic deformation capacity of a certain magnitude and direction and in certain areas such that they allow the achievement of excellent support and comfort conditions. The shell provides an elastic balancing of the seat back, as well as maintaining a comfortable and safe support whatever the position of the user.

In accordance with this invention, the frame of the seating element is made of a cross-sectionally flexible continuous wall and a reinforcing element disposed in internal surface of the wall for providing rigidity to certain parts of the frame and a given controlled flexibility to other parts of the frame.

Furthermore, and in accordance with this invention, the frame wall is split in three areas, a lower seating area, an upper seat back area and an intermediate transition area.

The fore mentioned reinforcing element includes a rigid reinforcing frame and straps that are elastically flexible in the cross-sectional direction. The rigid frame runs upon the transition area and extends slightly into the seating area on one side and into the seat back area on the opposite side. The straps, disposed longitudinally upon the median part of the seat back area, are slidably joined at their upper end to the seat back area for partial longitudinal freedom, whereas the lower ends of the straps are fixed to the rigid frame. The straps preferably have a level of resistance to cross-sectional bending higher than that of the frame, being preferably made of steel.

In order to cause a backward deformation of the seat back, a relatively small force, sufficient to overcome only the resistance of the frame or shell, must be initially applied until the longitudinal sliding capacity between the frame and the straps is fully spent. Subsequently, a force sufficient to achieve the elastic deformity of the straps to continue deforming the seat back, which ensures the recovery of the initial seat back resting position when the force is removed.

The frame deformation capacity may be further controlled using variable height reinforcing ribs that extend and run over the internal surface of the frame.

It may be easier to understand the characteristics of the furniture subject of this invention, as expressed in the claims, as well as the advantages derived from it, reading the following description, prepared with the aid of the attached drawings, which show a non-limitative example of execution of the invention.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIGS. 8 and 9 are section views taken along lines 8—8 and 9—9 of FIG. 2 of the regulating mechanism, respectively;

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
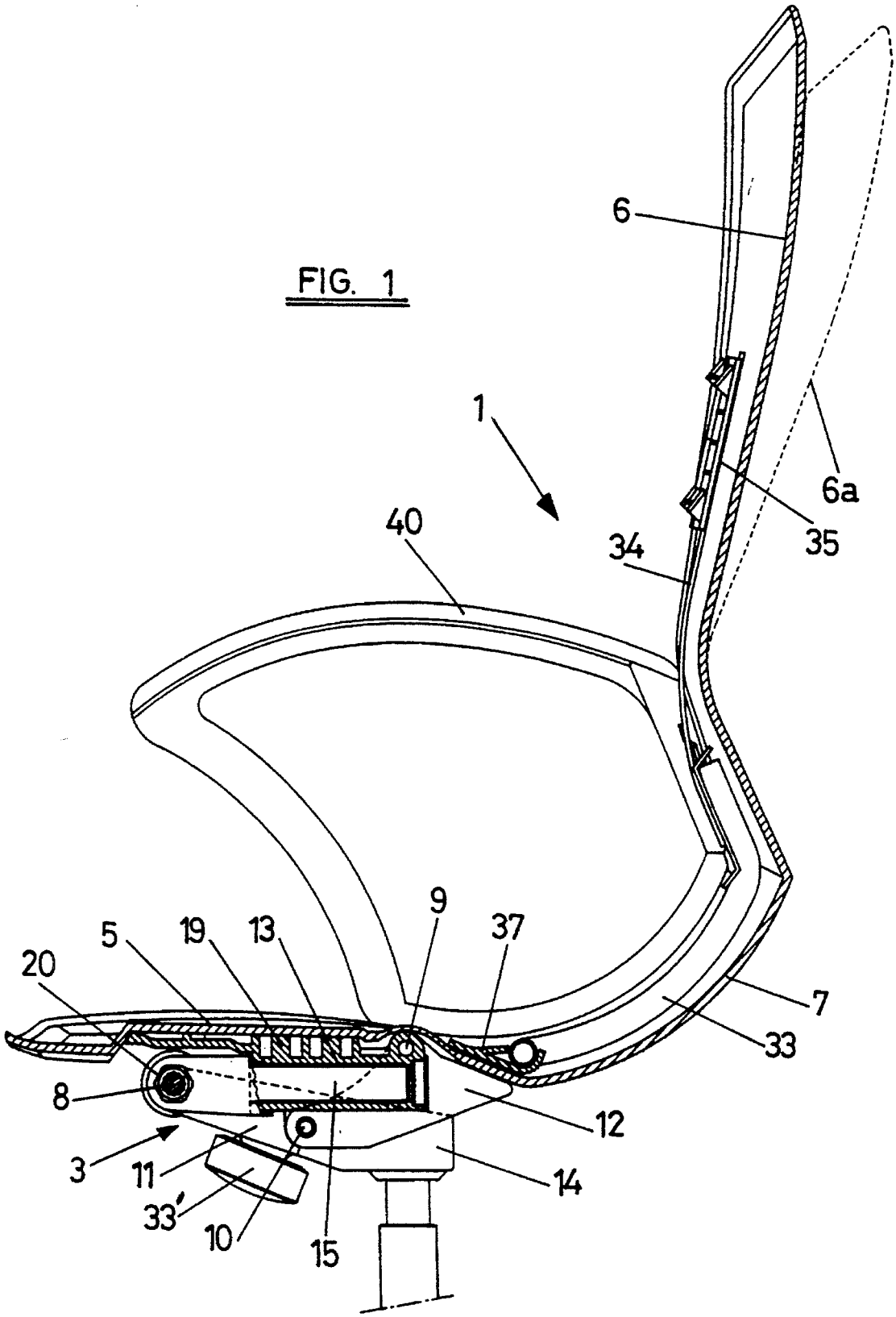
FIG. 1 is a cross-section of an armchair in accordance with the invention, showing the armchair in its front-most or non-fitted position.
Figure 2:
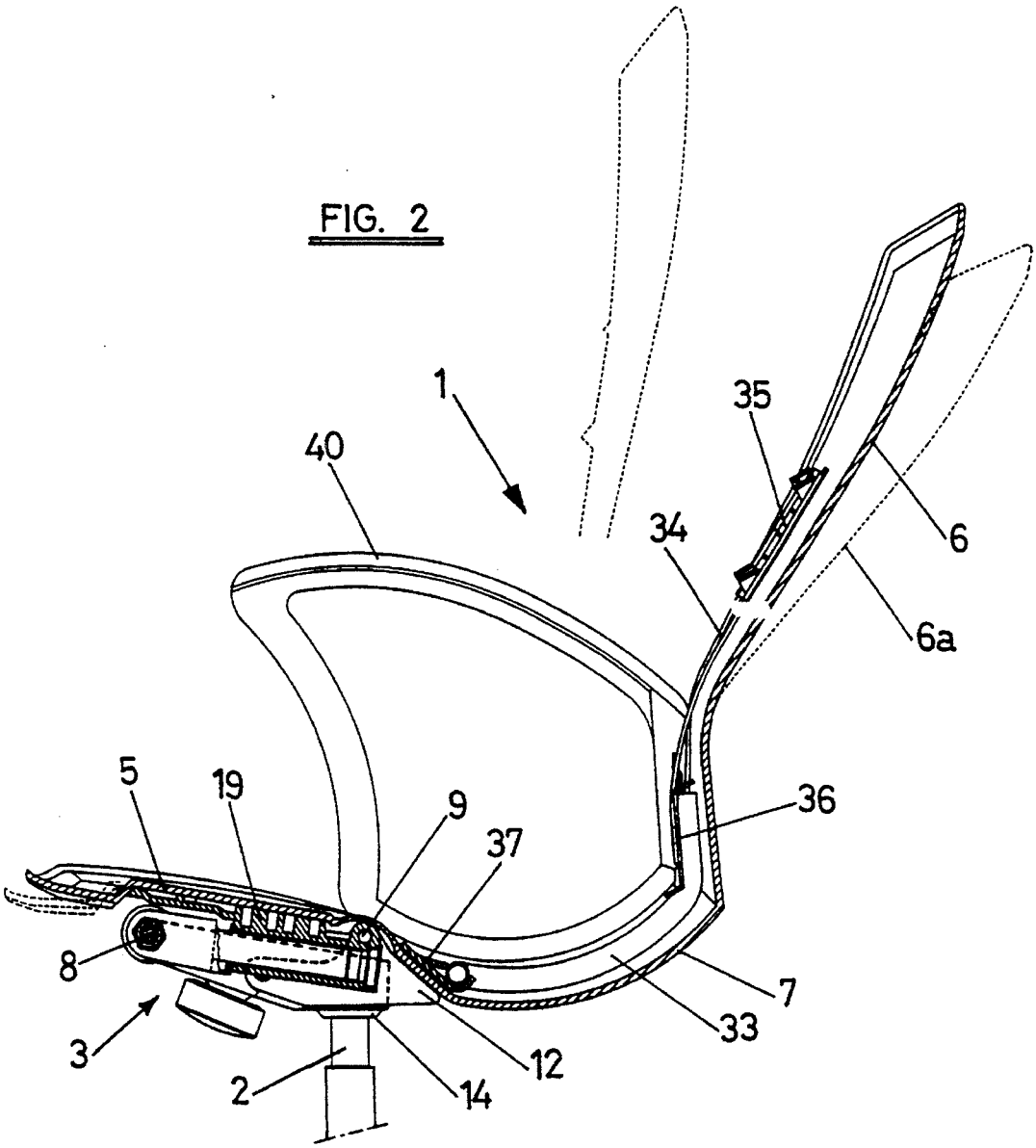
FIG. 2 is a cross-section of the armchair in FIG. 1, showing the armchair in its maximum tilt or back-most position.

The armchair shown in FIGS. 1 and 2 comprises a seating element, generally referenced as 1, a holding support, of which only the upper section of column 2 is shown, and a mechanism 3 for joining the seating element 1 to the holding support 2 and regulating the angular position of the seating element 1 relative to the support 2.

Figure 11:
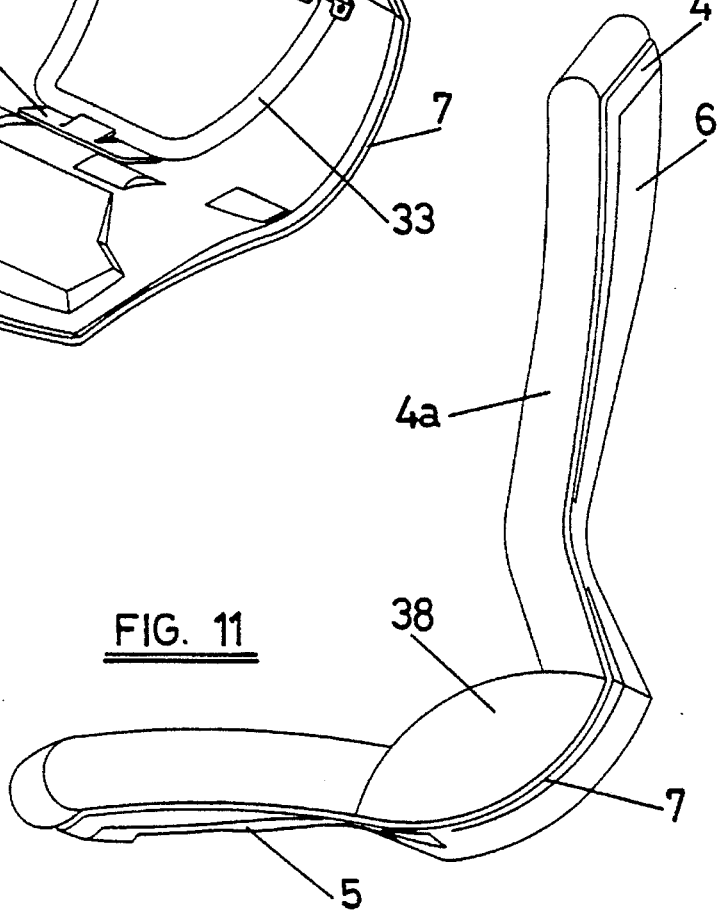
FIG. 11 is a side view of the seating element, including its back frame and its front filling element.

The seating element 1, as shown in FIG. 11, comprises a single piece back frame 4 and a front cushioned element **4*a*. The back frame 4 defines a seating area 5, a seat back area 6 and an intermediate transition area 7**. The three areas form a cross-sectionally flexible and continuous single piece frame or shell.

The regulating mechanism 3 comprises a structure that defines, in vertical section, an articulated triangle having angular points referenced as 8, 9 and 10, and a matching number of parallel turning horizontal spindles. The articulated triangle has a fixed length and fixed position side 11, a fixed length and tilting position side 12, and a variable length and tilting position side 13.

Side 11 of the triangle forms part of base part 14 of the structure, through which the mechanism 3 joins column 2 of the holding support.

Figure 3:
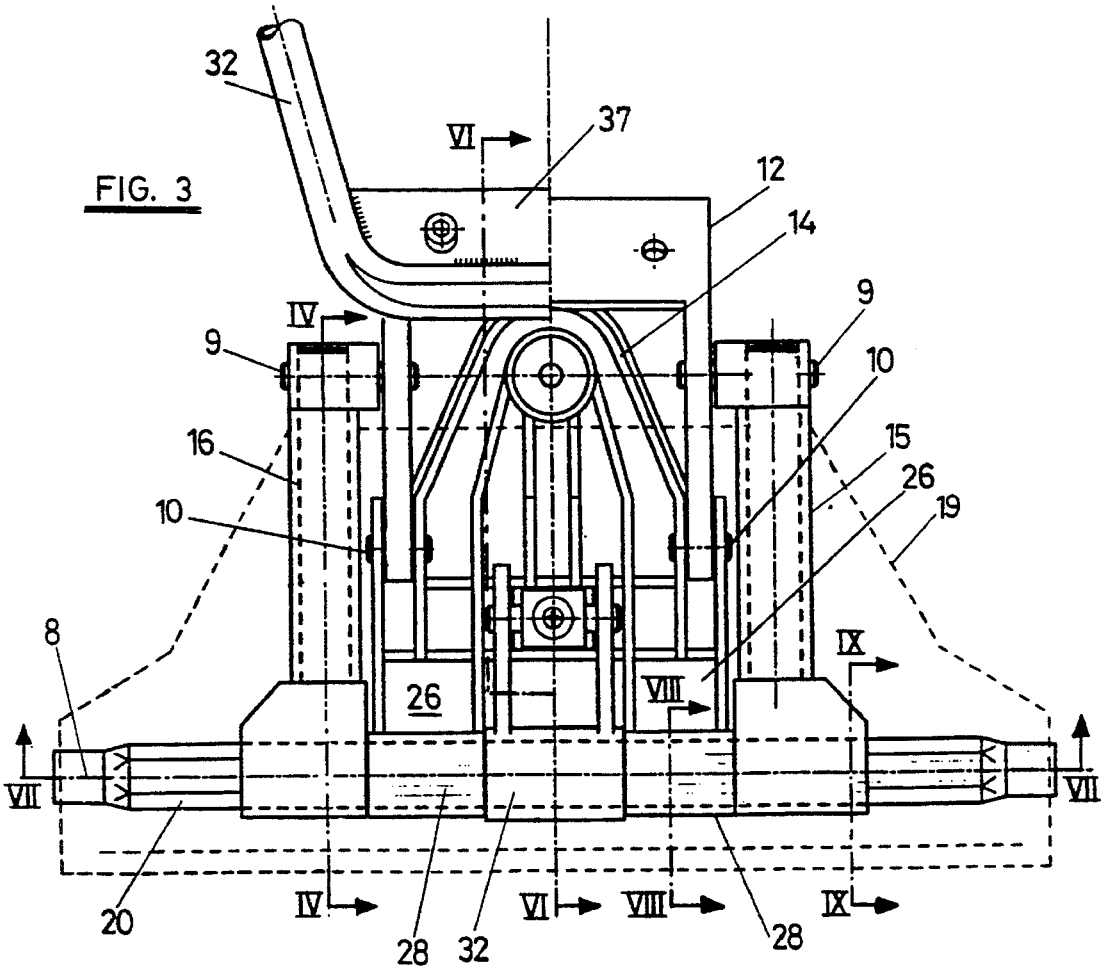
FIG. 3 is a top view of a regulating mechanism that joins the seating element to the holding support.

The variable length and tilting position side 13 comprises two telescopic pins 15 and 16, running parallel to each other, as shown in FIG. 3. Pin 15 is shown partially cut away in FIGS. 1 and 2 and in side elevation view in FIG. 9, whereas pin 16 is shown in side elevation in FIGS. 4 and 5. The two pins are made of two sections 17 and 18 telescopically connectable to each other. Section 17 of both pins join an upper plate 19, which shape is shown by dotted lines in FIG. 3, whereas section 18 of the two pins reaches the top or articulation axis 8, made up by a torsion bar 20.

Side 12 of the triangle comprises a rigid piece that projects out at its rear end with respect to the base piece 14.

The seating area 5 of the seating element is supported and fixed upon plate 19 and over the rear extension of side 12, as shown in FIGS. 1 and 2.

Figure 7:
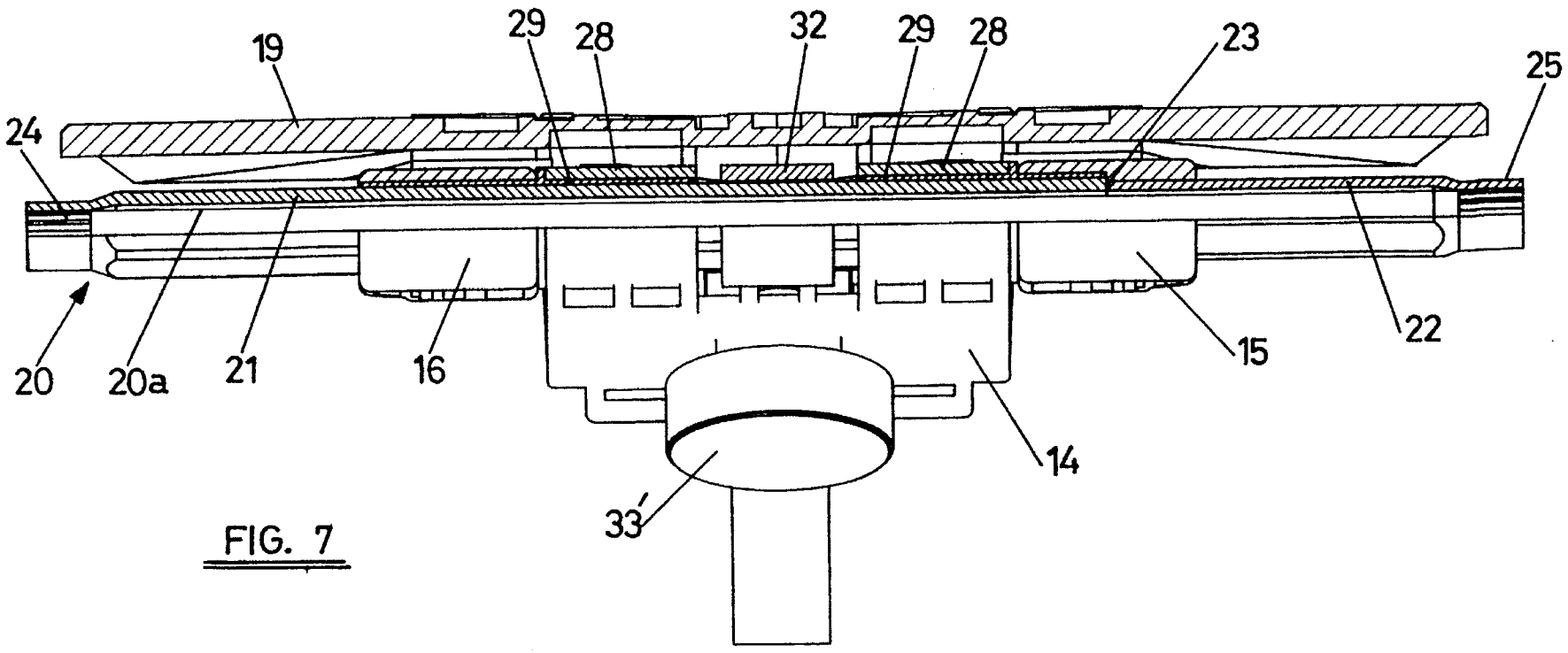
FIG. 7 is a section view taken along the line 7—7 of FIG. 3 showing the regulating mechanism.

As shown in FIG. 7, torsion bar 20 comprises a polygonal lengthwise central core **20*a*, and two independent tubular profiles 21 and 22 of different lengths, set upon the central core 20*a*. The outer ends of the two profiles 21 and 22, are disposed at the respective ends of the central core 20*a* and meet flush against each other at their internal ends 23. The profiles 21 and 22 are joined to central core 20*a*. In the illustrated embodiment, the ends of the profiles 21 and 22 are joined to ends of the core 20*a* through cross-section reductions 24 and 25 that present an axially channelled or notched internal profile, adapted to engage the polygonal section of the core 20*a* and prevent any relative rotation between the profiles and core. Profiles 21 and 22 run up to the internal section 23 with a possibility of turning in respect of core 20*a***.

Referring to FIG. 3, the base piece 14 of the structure forms two parallel arms 26 in the section defined by the fixed position and fixed length side 11. The free end of the parallel arm 26 have aligned pass-through housings 28 and intermediate bushings 29, as shown in FIGS. 7 and 8, through which the torsion bar 20 is fitted so that it turns freely, thus achieving relative turning freedom between the torsion bar 20 and side 11 of the triangle of the regulating mechanism.

Figure 4:
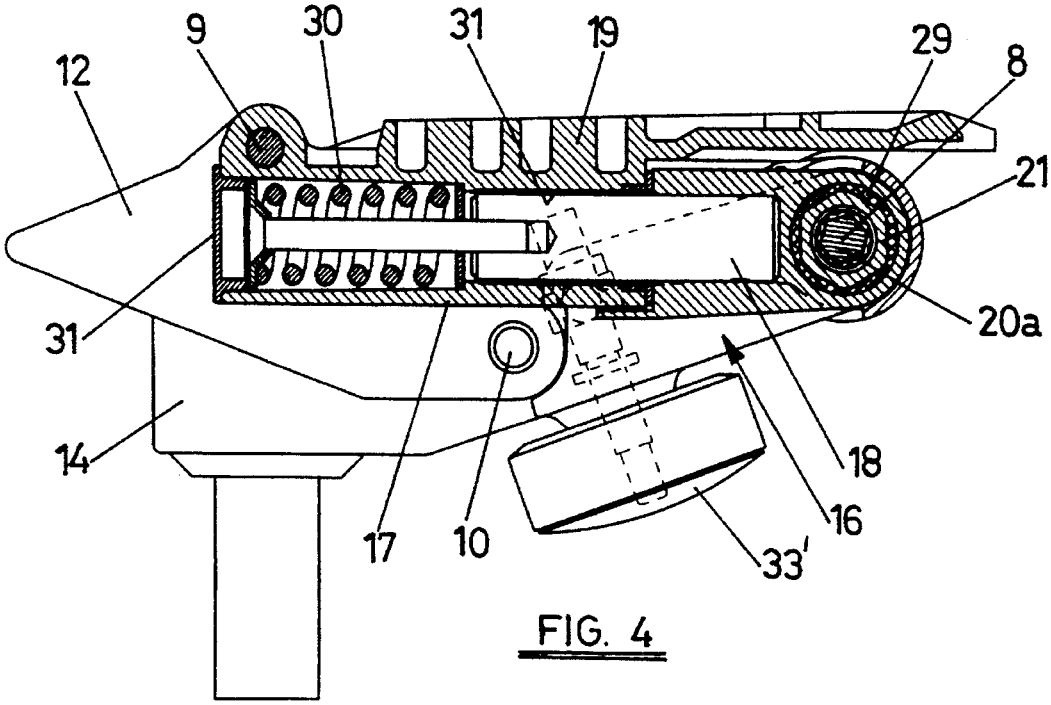
FIG. 4 is a section view taken along the line 4—4 of FIG. 3, showing the regulating mechanism when the armchair is in the front-most position in FIG. 1.

As may be seen in FIGS. 4 and 7, pin 16 is joined to torsion bar 20 through section 18 of the pin. Section 18 receives profile 21 of the torsion bar 20. Bushing 29 is interposed between the profile 21 and section 18 to ensure free turning between the profile 21 and pin 16. As may be seen in FIG. 4, pin 16 includes a compression spring 30. The tension strength of spring 30 may be regulated by using a threaded cap 31.

Pin 15, as shown in FIGS. 7 and 9, is joined to the torsion bar 20 through the tubular profile 22, all of which have adjacent polygonal sections for preventing any relative turning between pin 16 and the torsion bar.

Both pin 15 and pin 16 include an auto-lubricating contact bushing between the telescopic sections 17 and 18 that prevents adherence or gripping between sections 17 and 18 and ensures a constant degree of friction between them.

Figure 6:
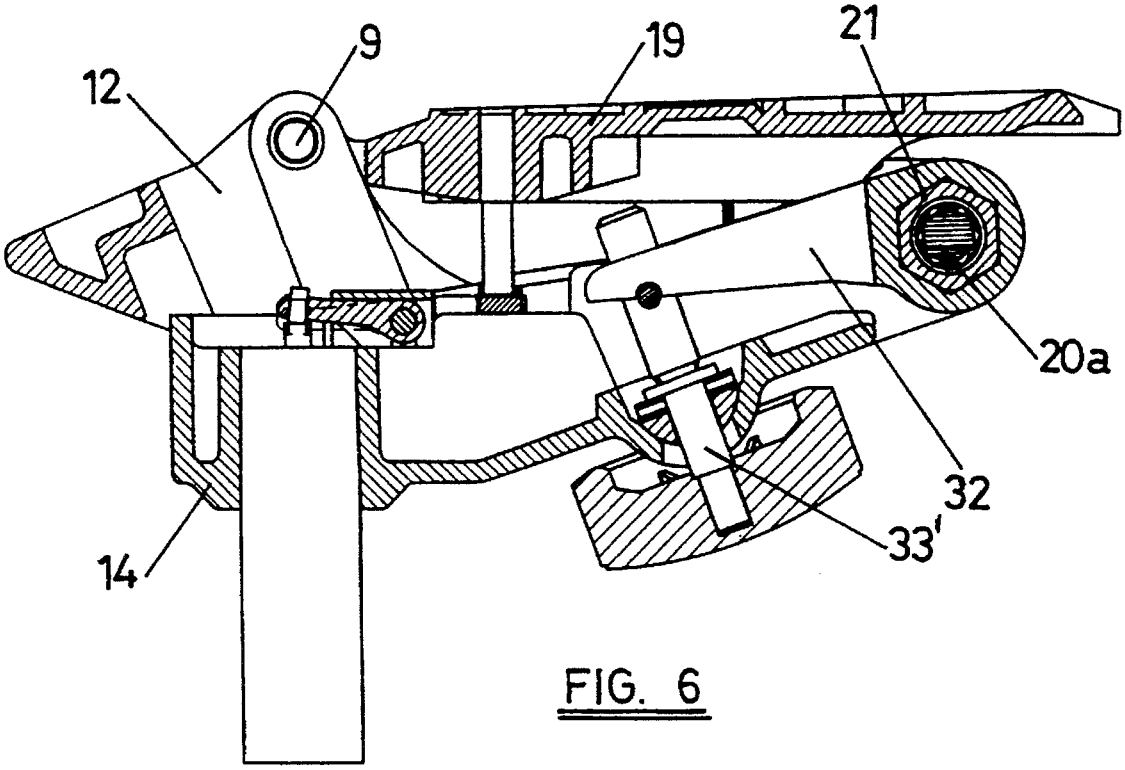
FIG. 6 is a section view taken along the line 6—6 of FIG. 3, showing the regulating mechanism.

Finally, a central lever 32 is anchored to the profile 21 of the torsion bar as shown in FIGS. 3, 6 and 7. The lever 32 includes a pass-through section having an internal surface for engaging profile 21, and preventing relative turning therebetween. The free end of the lever 32 rests upon an actuation lever 33 assembled upon base 14 defining fixed length and fixed position side 11.

With the fore mentioned arrangement, pin 15 is joined to one of the ends of the torsion bar, through tubular profile 22, whereas lever 32 is secured to the opposite end of the torsion bar through tubular profile 21 such that the torsion bar is free to turn relative to pin 16 and to support 14, which defines fixed length and fixed position side 11. The inclination of lever 32 may be varied through the actuation of control 33, and with it the strain of the torsion bar 20.

Figure 10:
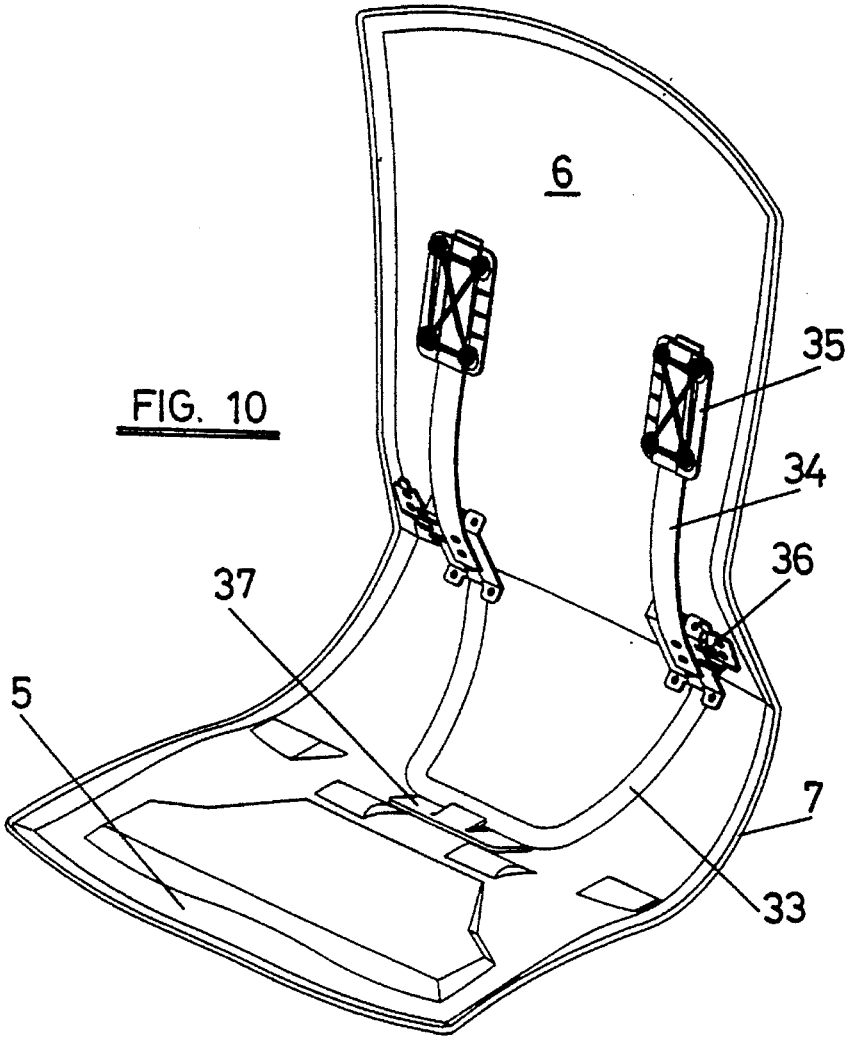
FIG. 10 is a perspective view of the seating element frame.

As may be seen in FIGS. 1, 2 and 10, the frame of the seating element comprises a continuous wall. A reinforcement element, including a rigid reinforcing frame 33 and straps 34 that are cross-sectionally elastically flexible is attached to the internal surface of the wall. The rigid reinforcing frame 33 is disposed in the transition area 7 and extends slightly into the seating area 5 at one side, and into the seat back area 6 at the opposite side. The straps 34 run lengthwise upon the median part of the seat back area 6. The upper end of the straps 34 are joined to seat back area 34 through plates 35, which permit partial sliding movement, whereas the lower end of the straps 34 are joined to the rigid reinforcing frame 33. The bending resistance of straps 34 are higher than that of the frame seat back area 6.

The rigid reinforcing frame 33 is fastened at one side by plates 36 and at the opposite side by a central part 37. The central part 37 may be used as a fixing element of the rear section of the seating element 5 to the part 12 that defines the fixed length and tilting position side of the regulating mechanism triangle.

Referring to FIGS. 10–11, the internal surface of the frame is adapted to receive a cushioned element 4*a*. In a preferred embodiment, it is preferred that the cushioned element 4*a* includes an intermediate lens shaped element 38, located in coincidence with the intermediate transition area 7 of the frame. The purpose of this lens shaped body 38 is to support the pelvis of the user of the armchair.

FIG. 1 represents an armchair at its front-most position, in which area 6 of the seat back may bend backwards until it takes up the position shown by a dotted line and given the reference number 6*a*. The maximum bending degree is defined by the bending capacity of straps 34.

Through the regulating mechanism 3, the user may tilt back or list the seating element, between the positions represented in FIGS. 1 and 2. Referring to FIG. 2, the seat back area 6 may also bend backwards until it reaches position 6*a*.

Upon passing from the position shown in FIG. 1 to the position shown in FIG. 2, pins 15 and 16 lengthen, increasing their length on side 13 of the regulating mechanism triangle. At the same time, there is tilting movement on that side, against the power of the torsion bar. There is also a tilting movement on side 12 of the regulating mechanism triangle synchronized relative to side 13. All of these movements, which are controlled by torsion bar 20, the calibration of pins 15 and 16 and the characteristics of bushings 31 incorporated into the pins, cause the tilting of the seating area 5, as well as a minimal elevation of the leading edge of the seating area 5, all of which correctly simulate the absolute and relative movements of the bone structure of the human body, including, for example, the pelvis or femur.

Figure 5:
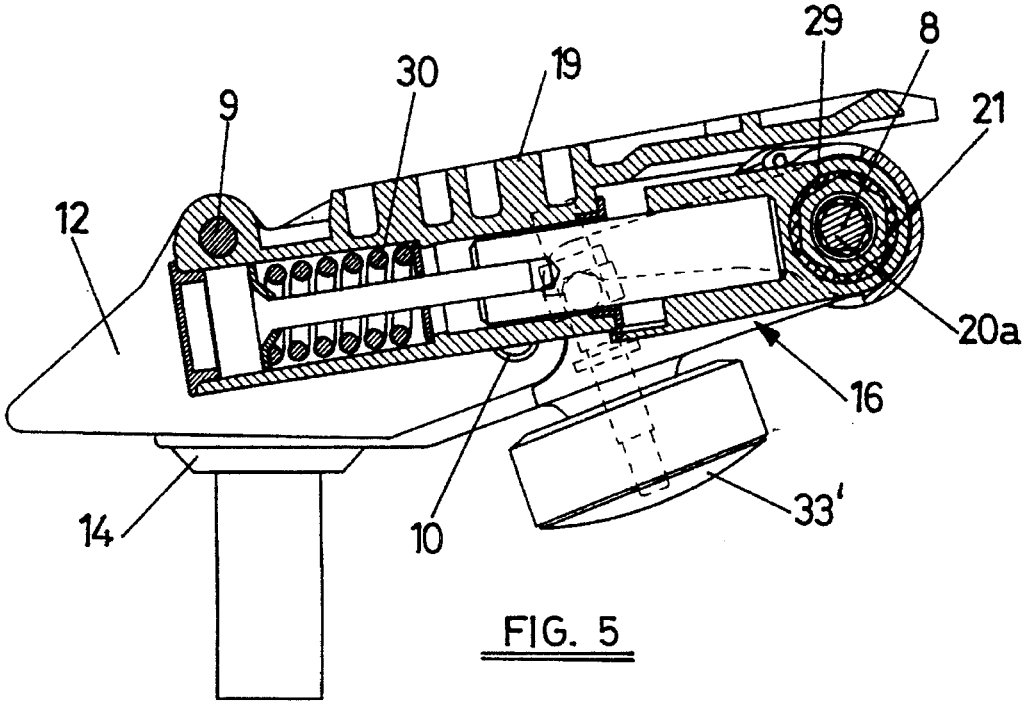
FIG. 5 is a section similar to FIG. 4, showing the regulating mechanism when the armchair is in the maximum tilt or back-most position in FIG. 2.

FIGS. 1 and 2 show the contracted and expanded positions of pin 15. FIGS. 4 and 5 represent its minimum and maximum length positions. In FIG. 5, the spring 30 is compressed thereby increasing the response or recovery capacity of the armchair from the FIG. 2 position to the FIG. 1 position.

The frame of the seating element shows two bending areas, one located between seating area 5 and transition area 7 and the second one in the lower half of seat back area 6.

Pin 15 serves as an element to transfer bending moment and guarantee proper maintenance of the seating element selected position. The purpose of pin 16 is to balance the pliant triangle and to enable mechanism recovery, as already mentioned.

The inclusion of the straps 34 in the seat back area 6 controls cross-sectional bending of the seat back area, permits torsion movements, and may also reach a high enough height to properly support the back up to shoulder height.

The internal surface of wall 4 has a reinforcement element comprising a rigid reinforcing frame 33 and straps 34 that are cross-sectionally elastically flexible. As may be seen in FIG. 10, the rigid reinforcing frame 33 goes through the intermediate transition area 7 and extends slightly over the seating area 5 on one side, and into the seat back area on the opposite side. The straps 34 run lengthwise upon the median portion of the seat back area 6. The straps are fixed at their upper end to the wall 4 by way of attachments 35 that allow the straps to slide lengthwise relative to the wall 4, whereas at the lower ends of the straps are fixed to the rigid reinforcing frame and to the wall 4 using the attachments 36, which may also be used to fix arms 40, FIG. 1.

It is preferred that straps 34, preferably made of steel, have a cross-sectional bending resistance higher than that of the upper area of the seat back 6.

The reinforcing element made up of reinforcing frame 33 and straps 34 lend rigidity to the transition area of the shell and further control seat back area bending. The rigid reinforcing frame 33 may consist of a generally inverted U form, which adopts a cross-sectional curvature that matches that of the internal surface of the frame upon which it is applied.

Figure 12:
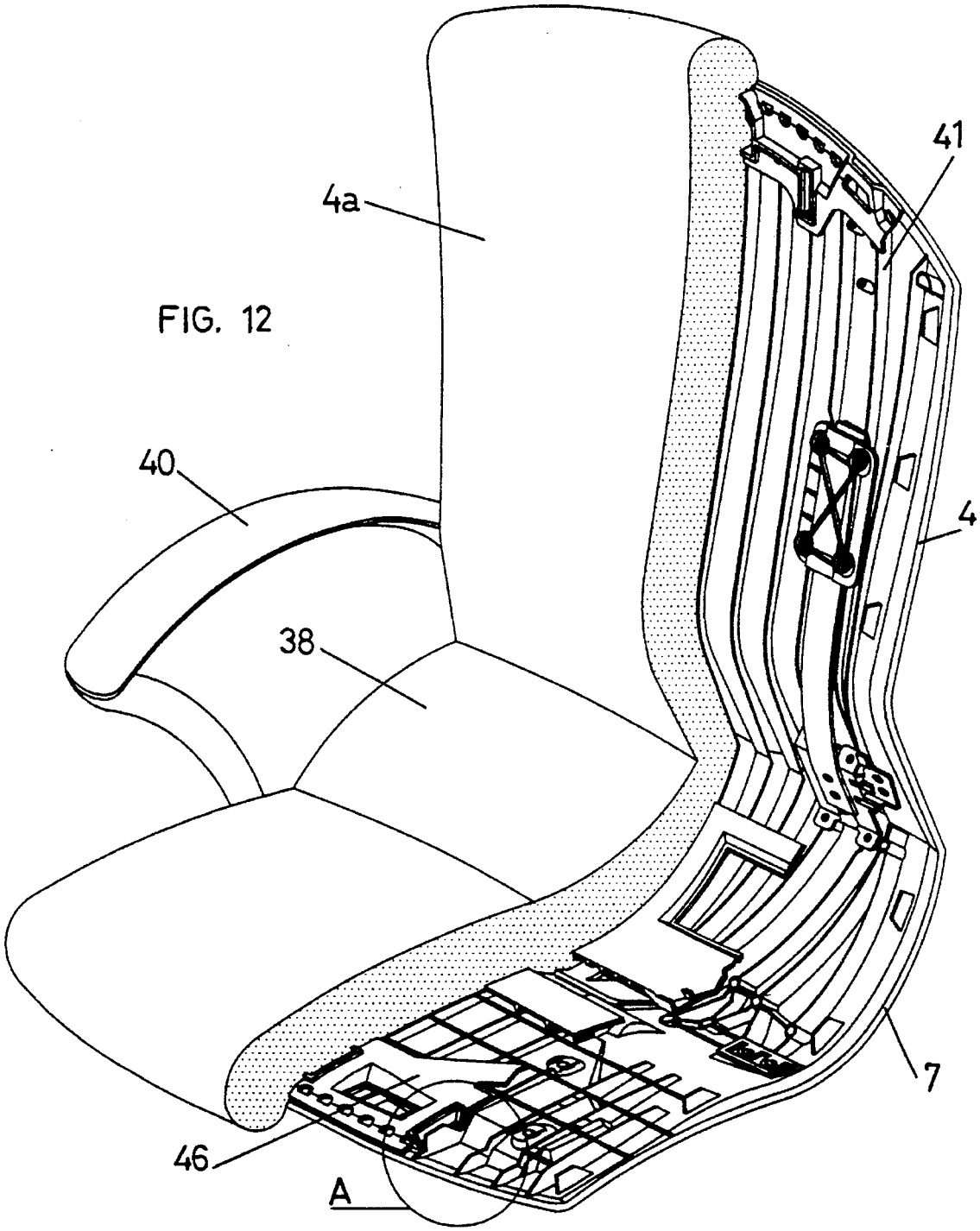
FIG. 12 is a frontal partial cut away view of the seating element.

As previously mentioned, wall 4 of the frame or shell may be fitted with lengthwise ribs 41 on its internal surface (FIG. 12), which enhance its rigidity. The height of the ribs may be varied in accordance with the level of rigidity sought.

Figure 13:
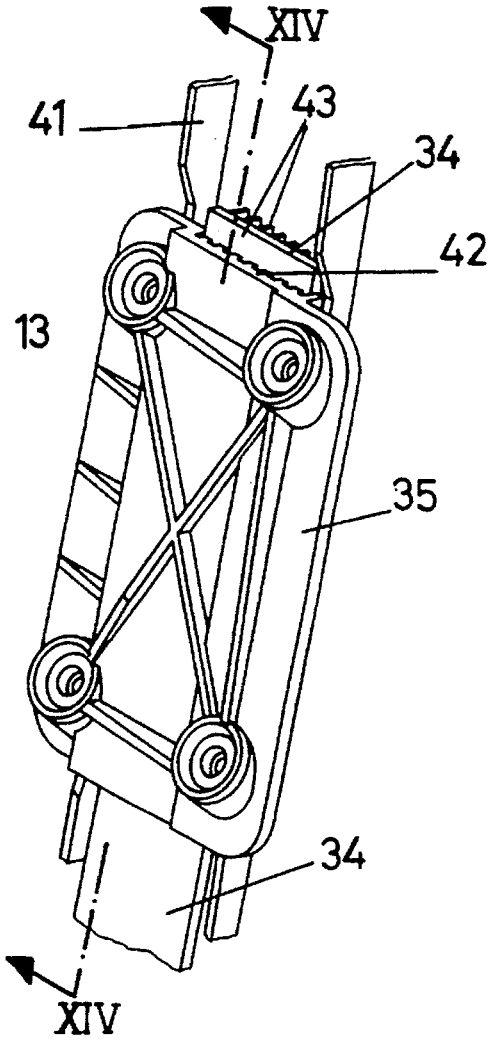
FIG. 13 is an enlarged view of the joint at the upper end of one of the frame ribs.
Figure 14:
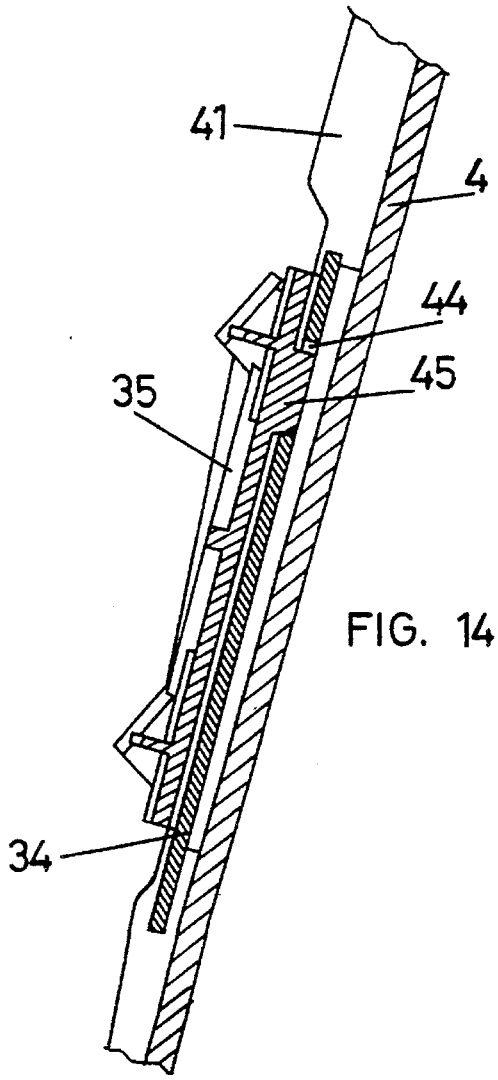
FIG. 14 is a section view taken along the line 13—13 of FIG. 13 showing the upper strap joint.

Referring to FIGS. 13–14, the attachments of the straps may include a plate 35 that is attached to wall 4 of the frame and which defines a lengthwise passage 42, such that the strap 34 is disposed between the bottom of the passage and the internal surface of wall 4. The opposing surfaces of passage 42 and wall 4 of the frame may have lengthwise ribs 43 that engage the surfaces of strap 34.

The arrangement described for the anchor shall allow relative sliding between the straps 34 and plates 35. This sliding capacity may be restricted by a mutual socket which, as shown in FIG. 14, may consist of an opening or window 44 formed into the billets 34 and a projection 45 that projects out from the internal surface of plate 35 for engaging the window. The length of the projection 45 shall be smaller than that of window 44. The differences of these lengths determines the lengthwise sliding capacity of the billets 34 relative to plates 35 and the passage 42 defined between the plate and the seat back area 6 of the frame.

The large bending capacity of frame 4 permits the back of the seat to bend cross-sectionally whenever it is pushed backwards by a user. This bending motion produces relative sliding movement between the billets 34 and the passage 42 defined between the plates 35 and the seat back area 6, until the projection 45 of the plate 35 engages the lower edge of the opening 44 of the billets 34 as shown in FIG. 14. Thereafter, the billet and frame form a pliant joint structure which considerably increases the bending resistance, so that the elastic resistance of straps 34 and frame 4 must be overcome without relative sliding, in order to increase seat back deformation. The elastic deformation of the straps ensures the recovery of the original resting position of seat back area 7, upon the cessation of the deformation force.

The straps 34 also allow the seat back to withstand great efforts without reaching levels of deformation that may be undesirable for the seat back.

The independent sliding movement of both straps 34 permit the seat back area 7 to enjoy a given bending movement capacity, which may arise when the user pushes his back further towards one side or the other.

The inclusion of straps 34 also allows the seat back area 6 to reach a desired height, so as to offer full back support to the user, up to shoulder height.

The combination of the bending capacity of the wall 4 and the straps 34, permits deformation of the seat back between an initial or first stage and a second stage. The initial stage, which only utilizes the bending capacity of area 6 of the seat back demands a relatively minor effort, second stage engagement of the support of projection 45 at the lower edge of window 44 of the straps 34 (FIG. 14), which the straps and seat back take part, presenting a bending resistance greater than that offered by seat back 6 on its own.

As shown in FIGS. 4 and 11, frame 4 is configured so that it admits a filling element **4*a* that includes a lens shaped section portion 38 configured to engage transition area 7** of the frame and support the pelvis area, allowing the user's column to maintain its proper position.

As is typical in this type of furniture, the cushioned element 4a includes a reinforcing frame 46 and attachment clips for attaching the cushioned element to the frame.

Figure 15:
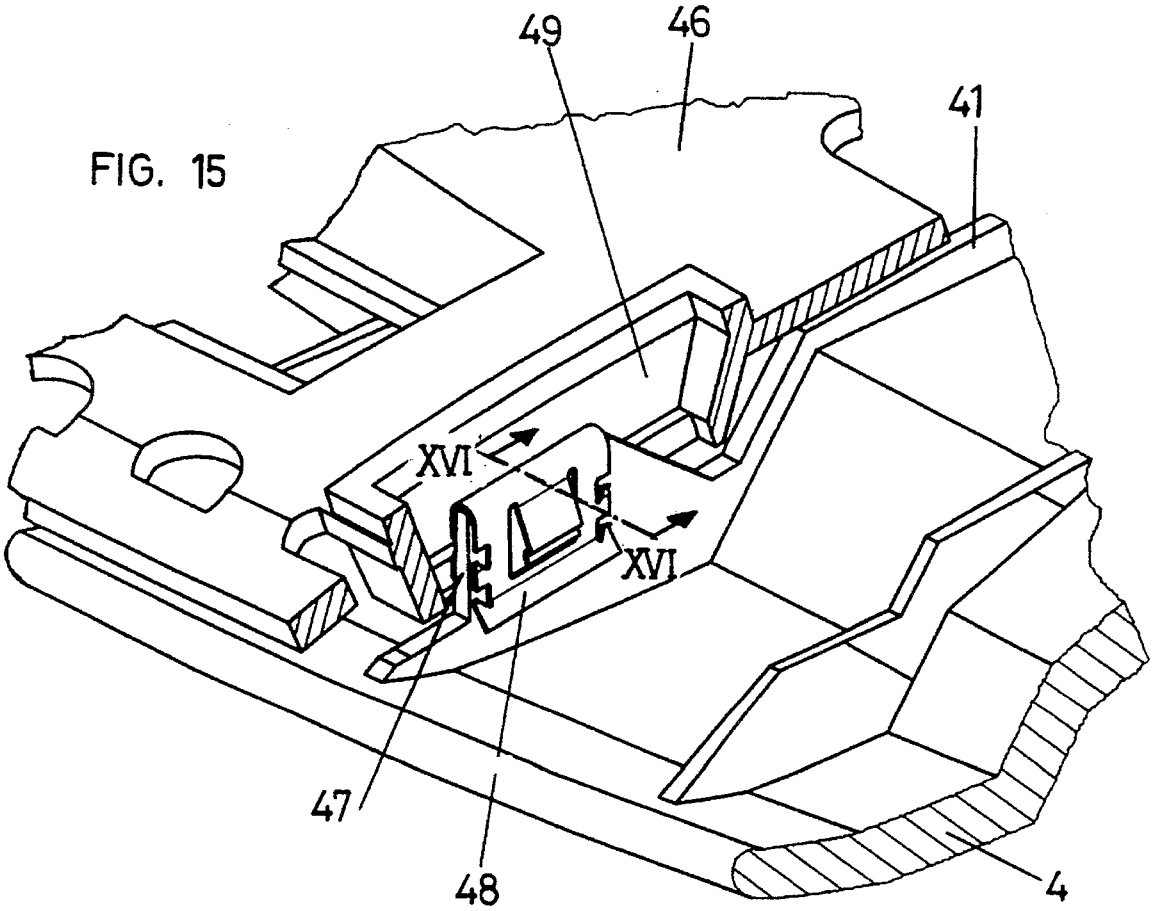
FIG. 15 is an enlarged perspective view of detail A of FIG. 12.
Figure 16:
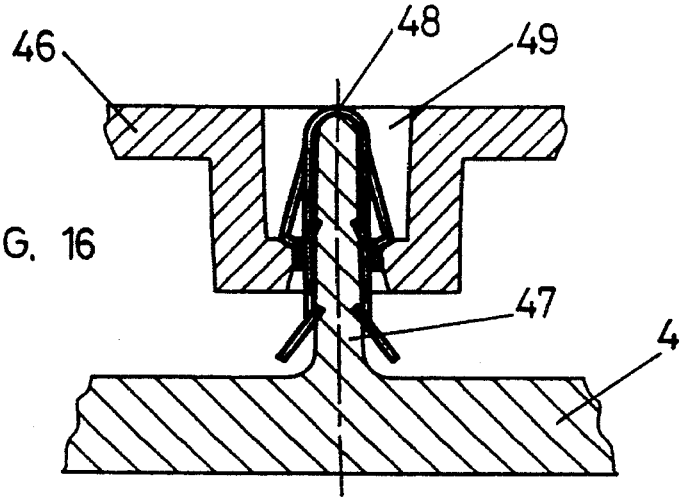
FIG. 16 is a section view taken along the line 16—16 of FIG. 15.

As may be seen in FIG. 15, the internal surface of the frame 4 has tabs 47 which may be shaped into the ribs 41 of the frame. In the embodiment shown in FIGS. 15 and 16, retention clips 48 include anchoring pins and tongues for engaging tabs 47. Tabs 47 with the clips 48 properly attached therein are introduced through the confronting openings or windows 49 formed in the reinforced frame 46 of the cushioned element 4a.

This attachment system allows disassembly and assembly of the cushioned element **4*a* as often as may be wished, due to the elasticity of the anchoring pins and tongues of the clips 48**.

All the tongues 47 and clips 48 are arranged in frame 4 in the lengthwise direction, allowing a predetermined relative sliding movement between the frame and the cushioned element, which ensures the coupling cavity, without creating tensions tending to disassemble the cushioned element in response to movement of the user.

It will be appreciated that other clip arrangements or attachment systems may be used.

All in all, the seat subject of this invention ensures a perfect body support, achieving a great deal of comfort, allowing proper synchronization of the various tilting and bending movements and maintaining stable equilibrium in any selected angular position of the seating element.

The armchair is fitted with supporting arms 40 that may adopt any configuration, as well as locking controls, not shown.

I claim as my invention:

1. An ergonomic self balancing armchair comprising a seating element, a rigid holding support for receiving the seating element and a mechanism for regulating the angular position of the seating element relative to the support, a frame defining a seating area, attached to the regulating mechanism and a seat back area, a leading cushioned element attached and fixed to the frame, wherein the regulating mechanism includes an articulated triangle structure having angular ends having first, second, and third rotating horizontal spindles, a fixed length and fixed position first side, a fixed length and tilting position second side and a variable length and tilting position third side, the second and third sides having means to support and fix the seating element, the first side attached to the regulating mechanism, the first spindle disposed between the first and third sides having a torsion bar rotatably attached to the fixed length and position first side and rigidly attached to the variable length and position third side, and the torsion bar is attached to an adjustable angular position lever, a free end of the lever supports an actuation control attached to the fixed length and position first side, and the frame has an internal surface for fixedly receiving a reinforcing element for enhancing the rigidity of the rear section of the seating area which controls the cross-sectional bending capacity of the seat back area and allows a certain torsion degree or capacity of said seat back.

2. An armchair as set forth in claim 1, wherein the variable length and tilting position third side is disposed above the first and second sides of the regulating and includes two parallel telescopic pins, defined by two telescopically connected sections, one of the sections joining both pins to an upper rigid plate, and the other section attaches to the torsion bar; and the seating area of the seating element is supported by and attached to said plate, before the articulation spindle between the variable length and tilting position third side and the fixed length and variable position second side.

3. An armchair as set forth in claim 2, wherein the torsion bar includes two independent tubular profiles and each one of the telescopic pins is joined to the torsion bar through one of the tubular profiles of said bar, wherein one of the pins is rotatably fixed to the corresponding tubular profile and the other pin is rotatably connected to the other tubular profile has an adjustable compression spring that acts against the lengthening of said pin, and a contact socket disposed between the connected sections of the pins that prevents any adherence or gripping between both sections and ensures a constant degree of friction between both sections.

4. An armchair as set forth in claim 3, wherein the adjustable position lever is fixed to the torsion bar through the same tubular profile having rotatably connected pins.

5. An armchair as set forth in claim 1, wherein the torsion bar includes a lengthwise central core upon which are fitted, from its ends, two independent tubular profiles, the profiles having outside ends which are fixedly attached to the end of the core, without any rotational movement and internal ends which are rotatably attached to the core.

6. An armchair as set forth in claim 5, wherein each one of the telescopic pins is joined to the torsion bar through one of the tubular profiles of said bar, wherein one of the pins is rotatably fixed to the corresponding tubular profile and the other pin is rotatably connected to the other tubular profile has an adjustable tension spring that acts against the lengthening of said pin, and a contact socket disposed between the connected sections of the pins that prevents any adherence or gripping between both sections and ensures a constant degree of friction between both sections.

7. An armchair as set forth in claim 6, wherein the adjustable position lever is fixed to the torsion bar through the same tubular profile having rotatably connected pins.

8. An armchair as set forth in claim 1, wherein the fixed length and fixed position first side is defined by a relatively U-shaped element attached to the holding support through the central section and which side branches are articulated by an intermediate point to the fixed length and tilt position second side and have at their free end aligned pass-through housings for rotatably receiving the torsion bar; and the adjustable position lever is located between said branches.

9. An armchair as set forth in claim 1, wherein the fixed length and tilting position second side extends from the variable length and tilting position third side at a portion joining the rear end of the seating area of the seating element.

10. An armchair as set forth in claim 1, wherein the frame of the seating element includes a continuous wall defining the lower seating area, the upper seat back area, an intermediate transition area, and the internal surface for receiving the reinforcement element, the upper seat back area is elastically pliant cross-sectionally and to torsion, the reinforcement element having a rigid reinforcing frame and straps elastically flexible cross sectionally, the reinforcing frame extends into the transition area of the seating element and extends slightly into the seating and seat back areas, the straps are disposed lengthwise over a median section of the seat back area such that the upper ends of the straps are slidably attached to the seat back and the lower ends of the straps are attached to the rigid reinforcing frame, and the straps have a resistance to cross-sectional bending greater than at the upper seat back area.

11. An armchair as set forth in claim 10, wherein the rigid reinforcing frame has a U-shaped tubular profile presenting a cross-sectional curvature matching the vertical profile of the transition area and attaches to the frame over the seating and seat back areas near said transition area.

12. An armchair as set forth in claim 10, wherein the upper portion of each strap is slidably disposed inside a passage defined between the internal surface of the seat back and a braking plate fixed to said seat back, and a billet capable of sliding within the passage and means for limiting the billet sliding capacity relative to the plate.

13. An armchair as set forth in claim 12, wherein the opposing sliding surfaces of plate and seat back consist of lengthwise ribs, that support themselves upon the billet.

14. An armchair as set forth in claim 12, wherein the means for limiting the sliding capacity between the billet and plate comprises a window in the billet and a projection projecting from the plate for engaging the window, and the projection having a lesser length than the window, such that the difference of length between window and projection define the sliding capacity of the billet relative to the plate.

15. An armchair as set forth in claim 10, wherein the cushioned element includes a cross-sectional lens shaped intermediate portion, matching the transition area of the frame.

* * * * *

UNITED STATES PATENT AND TRADEMARK OFFICE

CERTIFICATE OF CORRECTION

PATENT NO. : 5,601,336

DATED : February 11, 1997

INVENTOR(S) : Troyas-Bermejo

It is certified that error appears in the above-identified patent and that said Letters Patent is hereby corrected as shown below:

ON THE TITLE PAGE:

[56] References Cited: All foreign patents should be listed:

| | | |
|---|---|---|
| 0277912 | 1/1988 | Europe |
| 0107627 | 5/1984 | Europe |
| 87/04909 | 8/1987 | World Org. |
| G8806924.9 | 8/1988 | Germany |
| 384537B | 11/1987 | Austria |

Signed and Sealed this

Fourteenth Day of October, 1997

Bruce Lehman

*Attest:*

BRUCE LEHMAN

*Attesting Officer*

*Commissioner of Patents and Trademarks*